US005980015A

United States Patent [19]

Saruta

[11] Patent Number: 5,980,015

[45] **Date of Patent: *Nov. 9, 1999**

[54] INK JET PRINTING HEAD EMBODIMENT WITH DRIVE SIGNAL CIRCUIT OUTPUTTING DIFFERENT DRIVE SIGNALS EACH PRINTING PERIOD AND WITH SELECTING CIRCUIT APPLYING ONE OF THE SIGNALS TO PIEZOELECTRIC ELEMENTS THAT EXPAND AND CONTRACT PRESSURE GENERATING CHAMBERS

[75] Inventor: Toshihisa Saruta, Nagano, Japan

[73] Assignee: Seiko Epson Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/634,381

[22] Filed: Apr. 18, 1996

[30] Foreign Application Priority Data

Apr. 19, 1995 [JP] Japan ..... 7-094011
Mar. 14, 1996 [JP] Japan ..... 8-057949

[51] Int. Cl.[6] ..... B41J 2/205

[52] U.S. Cl. ..... 347/15; 347/11

[58] Field of Search ..... 347/15, 10, 11, 347/9, 94, 20, 68–72; 358/298

[56] References Cited

U.S. PATENT DOCUMENTS

| | | | |
|---|---|---|---|
| 4,459,601 | 7/1984 | Houkins | 347/68 |
| 4,561,025 | 12/1985 | Tsuzuki | 347/15 |
| 4,710,784 | 12/1987 | Nakayama | 347/15 |
| 4,714,935 | 12/1987 | Yamamoto et al. | 347/10 |
| 5,124,716 | 6/1992 | Roy et al. | 347/15 |
| 5,138,333 | 8/1992 | Bartky et al. | 347/11 |
| 5,285,215 | 2/1994 | Liker | 346/1.1 |
| 5,486,848 | 1/1996 | Ayata et al. | 347/15 |
| 5,552,809 | 9/1996 | Hosono et al. | 347/10 |

FOREIGN PATENT DOCUMENTS

| | | | |
|---|---|---|---|
| 0 608 835 A2 | 8/1994 | European Pat. Off. | B41J 2/045 |
| 55-17589 | 2/1980 | Japan | B41J 3/04 |
| 59-218866 | 10/1985 | Japan . | |
| 63-182153 | 7/1988 | Japan . | |
| 1-101160 | 4/1989 | Japan | B41J 3/04 |
| 415735 | 3/1992 | Japan | B41J 2/205 |
| 6218928 | 8/1994 | Japan | B41J 2/045 |

*Primary Examiner*—John Barlow
*Assistant Examiner*—C. Dickens
*Attorney, Agent, or Firm*—Sughrue, Mion, Zinn, Macpeak & Seas, PLLC

[57] ABSTRACT

A drive device for an ink jet type printing head which makes it possible to jet ink droplets having different sizes from the same nozzle, and with which the resultant image is high in picture quality and in gradation, and the printing operation is achieved at high speed. The drive device includes a drive signal generating circuit (23) which outputs within one printing period a first drive signal which is used to jet a relatively large ink droplet from the nozzle opening, and a second drive signal in succession to the first drive signal which is used to jet a relatively small ink droplet from the same nozzle opening. In response to a printing signal, one of the first and second drive signals is selected and applied to the piezo-electric elements (6) of the printing head. Thus, ink droplets having different sizes are selectively from the same ink nozzle.

7 Claims, 8 Drawing Sheets

INK JET PRINTING HEAD EMBODIMENT WITH DRIVE SIGNAL CIRCUIT OUTPUTTING DIFFERENT DRIVE SIGNALS EACH PRINTING PERIOD AND WITH SELECTING CIRCUIT APPLYING ONE OF THE SIGNALS TO PIEZOELECTRIC ELEMENTS THAT EXPAND AND CONTRACT PRESSURE GENERATING CHAMBERS

BACKGROUND OF THE INVENTION

1. Field of the Invention

This invention relates to a drive device for a printing head of an ink jet printer in which different size ink droplets are jetted from the same nozzle onto a recording medium such as a recording sheet.

2. Description of the Related Art

An ink jet printer is one type of dot matrix printer. In an ink jet printer, ink droplets are jetted onto the recording sheet according to binary-coded image signals, so that a character or image is formed with recording dots having the same size. In order to form an ink jet image which is variable in gradation, such as a picture, it is essential to reduce the weight of each ink droplet, and therefore the size of the resultant recording dot. If the size of the resultant recording dot is not reduced, the low density region of the printed image will have significant granularity.

A method of decreasing the weight of ink droplets has been disclosed in Japanese Patent Application (OPI) No. 17589/1980. In the method disclosed in this reference, the volume of the pressure chamber is changed, i.e., the chamber is expanded and contracted. In other words, the weight of the ink droplets is reduced by decreasing the force of expanding and contracting the pressure chamber. On the other hand, the high density region of the formed image must be filled completely with ink dots with no spaces between the ink dots. Hence, if the size of each recording dot is decreased, then the printing speed is decreased as much (when compared with the case where the recording dots are large).

Let us consider the cases where print resolving powers are 360 dpi and 720 dpi. In those cases, in order to completely fill the recording sheets with the recording dots, i.e., to form solid prints, the recording dots must be at least 100 $\mu$m and 50 $\mu$m, respectively. In the case where the print resolving power is 720 dpi, the printing speed is decreased to about a quarter (¼) of that in the case where the print resolving power is 360 dpi. In order to overcome this difficulty, it is necessary to increase the ink droplet jetting frequency by a factor of "4" (four-fold), or to increase the number of ink jetting nozzles by a factor of "4". However, to do so is rather difficult.

In order to solve the above-described problems, a technique has been proposed in which ink droplets having different weights are jetted from the same nozzle, to form an image that is variable in gradation (cf. Japanese Patent Publication No. 15735/1992, and U.S. Pat. No. 5,285,215). In this technique, a plurality of pulse signals are employed to form a plurality of minute ink droplets, and the number of minute ink droplets thus formed is adjusted to form a larger diameter ink droplet which is dropped onto the recording sheet.

In the technique described above, a plurality of minute ink droplets are combined to form one ink droplet larger in diameter. However, this process decreases the printing speed. Furthermore, since minute ink droplets must be combined before being dropped onto the recording sheet, the recorded dots are unavoidably small in the range of variations in diameter.

SUMMARY OF THE INVENTION

In view of the foregoing difficulties, an object of the invention is to provide a drive device for an ink jet type printing head which is able to jet ink droplets having different diameters from the same nozzle without changing the printing speed.

The foregoing object of the invention is achieved by the provision of a drive device for an ink jet type printing head in which a pressure generating chamber is expanded and contracted with a piezo-electric element which is confronted with the pressure generating chamber to cause a nozzle opening to jet ink droplets, wherein a first drive signal which is used to jet a relatively large ink droplet from the nozzle opening, and a second drive signal in succession to the first drive signal which is used to jet a relatively small ink droplet from the nozzle opening, are generated within one printing period; and According to the printing signal received, either the first or the second drive signal is selected and applied to the piezo-electric element, so that ink droplets having different sizes are jetted within one printing period.

With the drive device of the invention, a relatively large ink droplet is jetted first so that the oscillation of the meniscus due to the jetting of an ink droplet will not affect the following printing period.

BRIEF DESCRIPTION OF THE DRAWING FIGURES

Figure 5:
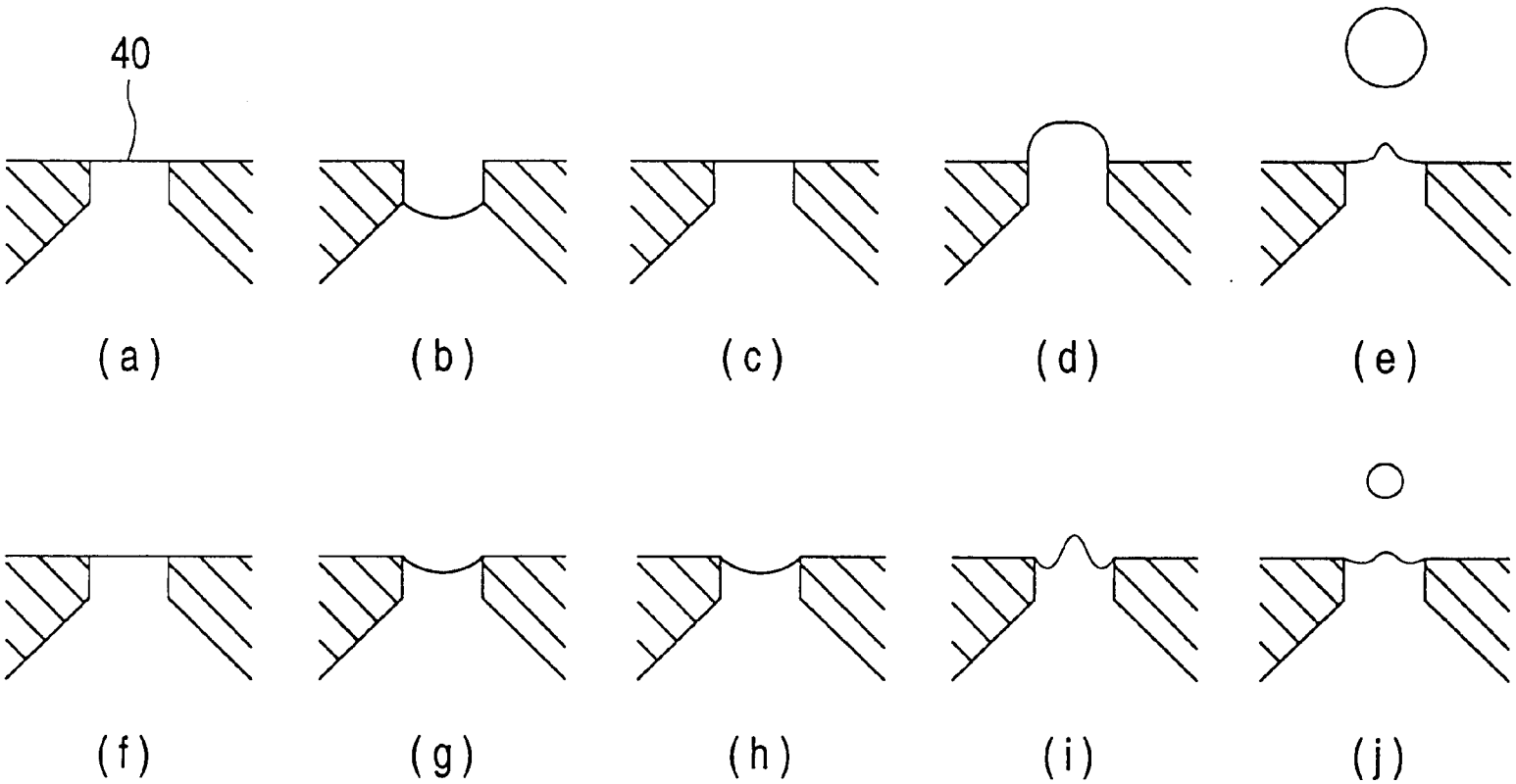
Figure 6:
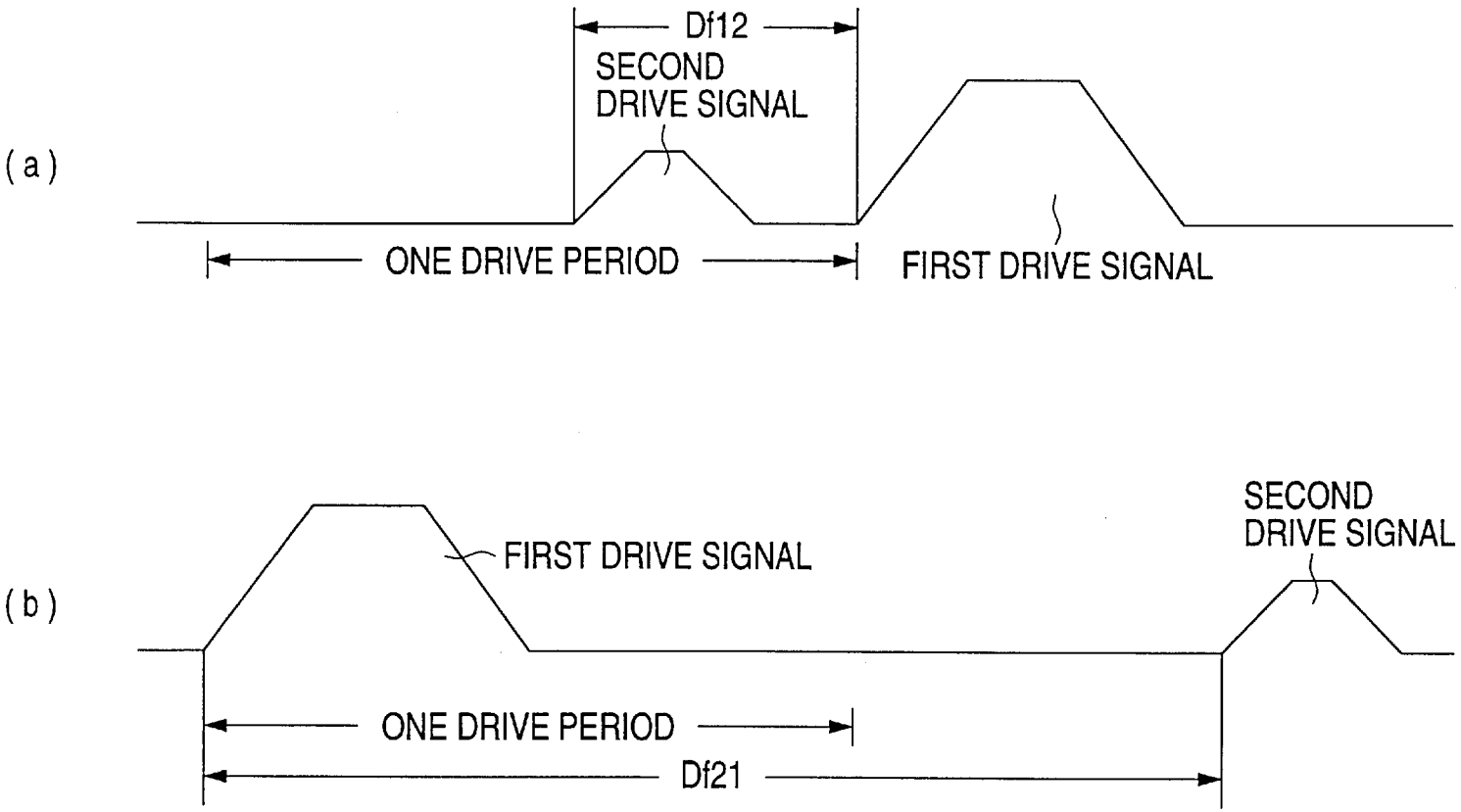
Figure 7:
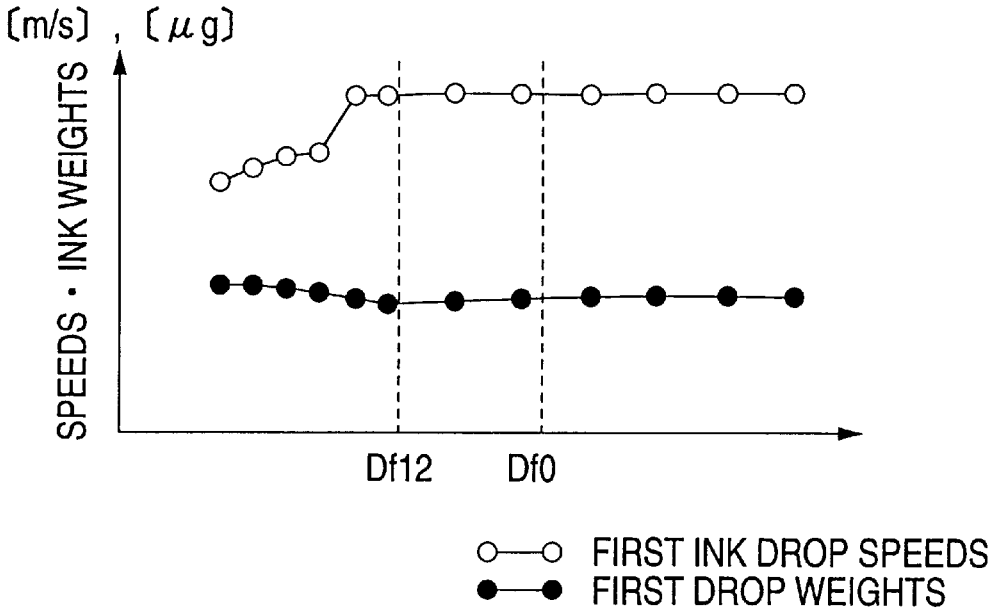
Figure 7:
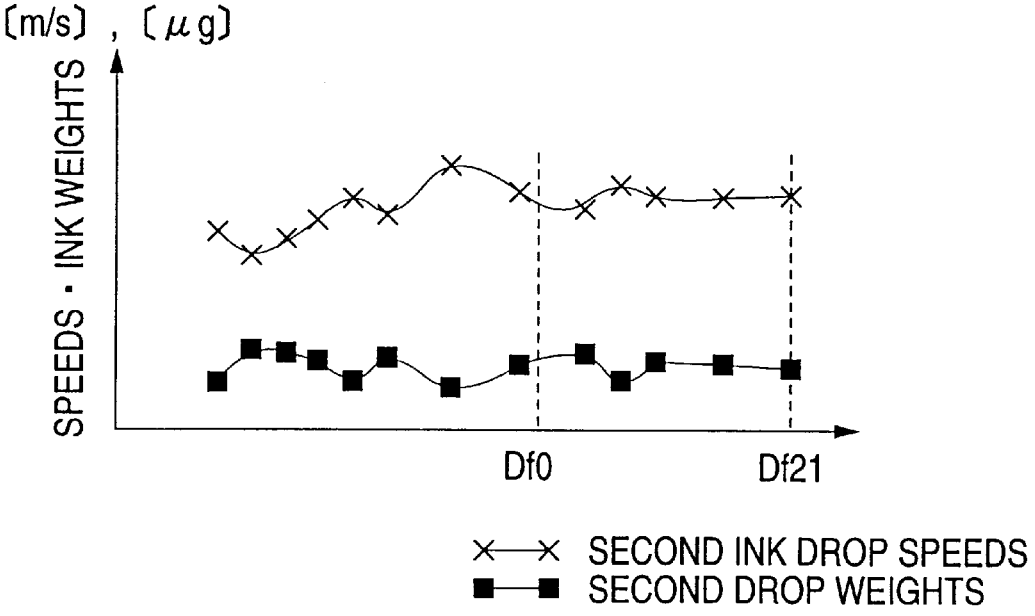
Figure 8:
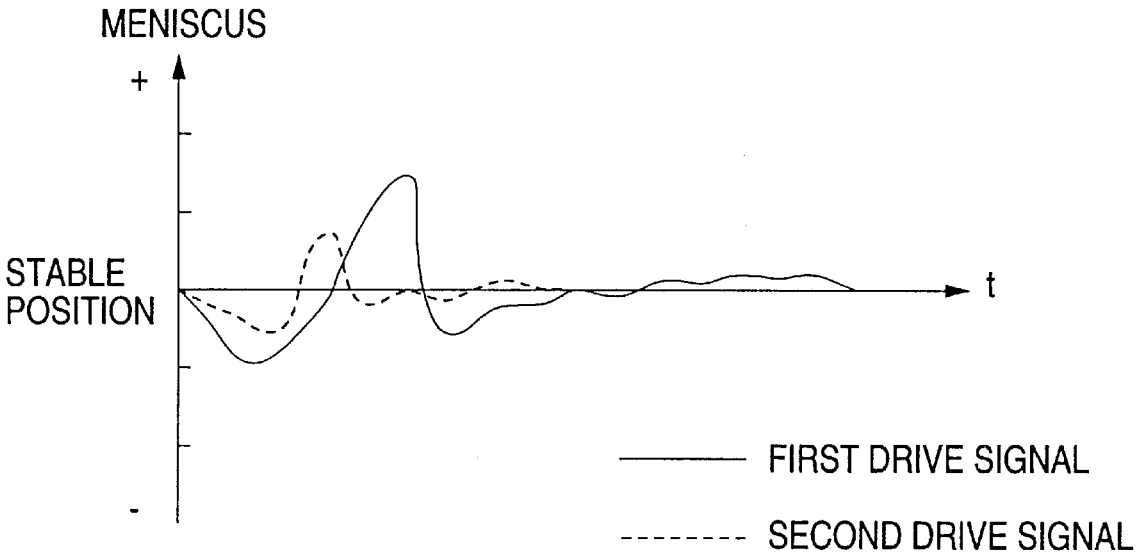

FIGS. 5(*a*) through 5(*j*) are diagrams showing the behavior of a meniscus in the formation of ink droplets;

FIGS. 6(*a*) and 6(*b*) are diagrams showing the selection of drive signals;

FIG. 7(*a*) is a graphical representation indicating first ink drop speeds and weights with drive time intervals which elapse from the application of second drives signals until first drive signals are applied, respectively;

FIG. 7(*b*) is a graphical representation indicating second ink drop speeds and weights with drive time intervals which elapse from the application of the first drive signals until the seconds drive signals are applied, respectively; and FIG. 8 is a graphical representation of the drives signals and the residual oscillations.

DETAILED DESCRIPTION OF THE PREFERRED EMBODIMENTS

Figure 1:
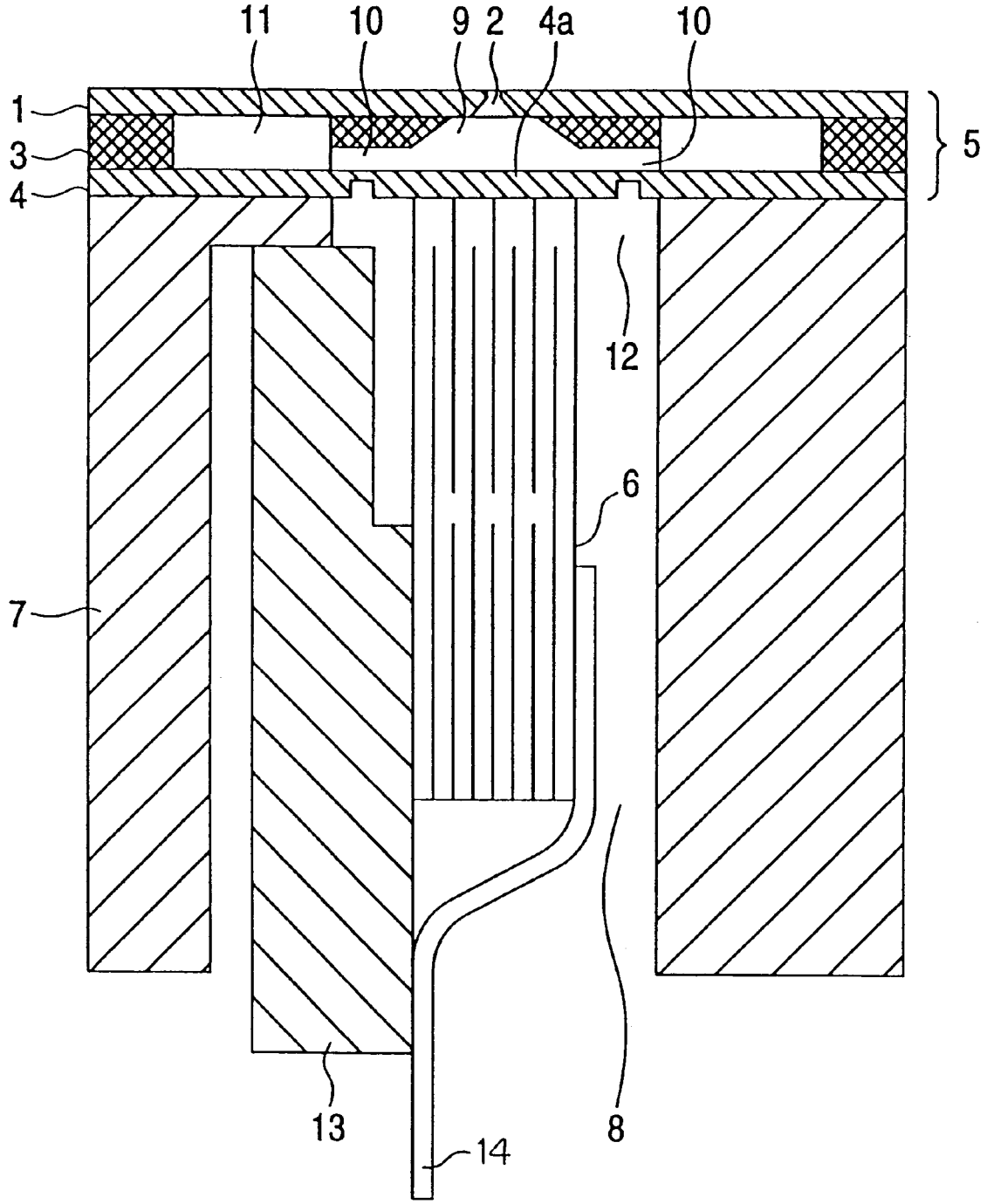
FIG. 1 is an explanatory diagram showing an example of an ink jet type printing head according to the invention.

FIG. 1 shows an example of an ink jet type printing head to which the technical concept of the invention is applied.

In FIG. 1, reference numeral 1 designates a nozzle plate having a nozzle opening 2; and 3, a flow-path forming board.

The board 3 has a through-hole defining a pressure generating chamber 9, through-holes or grooves defining ink supplying holes 10, and a through-hole defining a common ink chamber 11. Further in FIG. 1, reference numeral 4 designates a vibrating board which elastically deforms itself and is in abutment with the end of a piezo-electric element 6. The nozzle plate 1 and the vibrating board 4 are set on both sides of the flow-path forming board 3, thus forming a base board unit 5.

Further in FIG. 1, reference numeral 7 designates a base stand including a chamber 8 in which the piezo-electric element 6 is vibratingly accommodated. The piezo-electric element 6 is fixed through a fixing board 13 so that the island portion 4*a* of the vibrating board 4 is in abutment with one end of the piezo-electric element 6. The other end of the piezo-electric elements 6 contacts a drive signal circuit connection 14.

Figure 2:
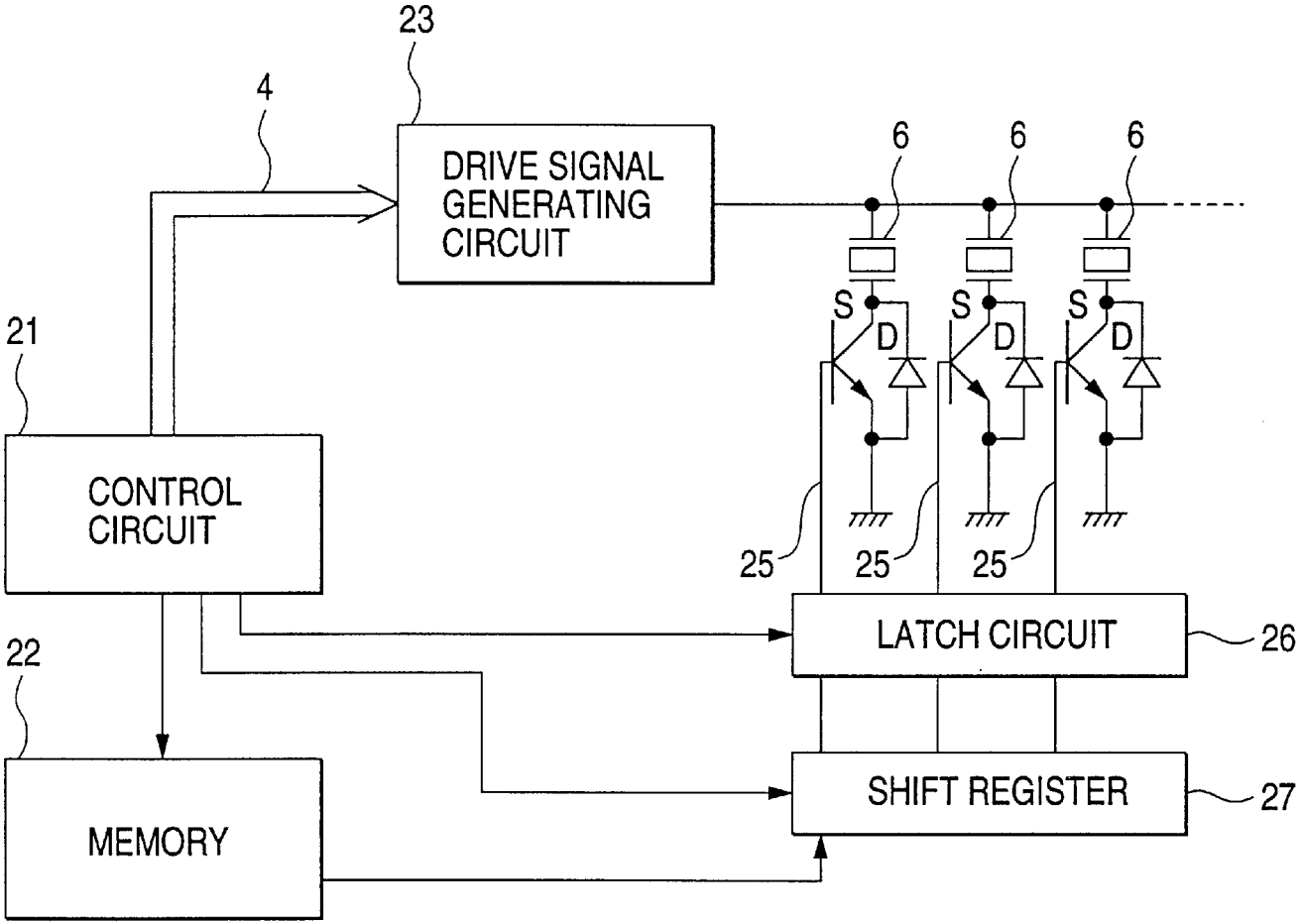
FIG. 2 is a circuit diagram, partly as a block diagram, showing the arrangement of a drive circuit according to the invention.

FIG. 2 is a block diagram showing an example of a drive circuit for driving the above-described printing head.

In FIG. 2, reference numeral 22 designates a memory for temporarily storing printing data; 23, a drive signal generating circuit for generating drive signals to vibrate (expand and contract) the piezo-electric element 6 of the aforementioned printing head; 27, a shift register for storing printing data which are transferred, in a serial mode, from the memory 22; and 26, a latch circuit for latching all the printing data at the same time which have been stored in the shift register 27. The output of the latch circuit 26 is applied to the control terminals of selecting circuits, namely, transistors "S", to control the conduction of those transistors "S". The aforementioned memory 22, drive signal generating circuit 23, latch circuit 26, and shift register 27 are controlled by a control circuit 21. In each of the transistors "S", a diode "D" is connected between the collector and the emitter as shown in FIG. 2.

Figure 3:
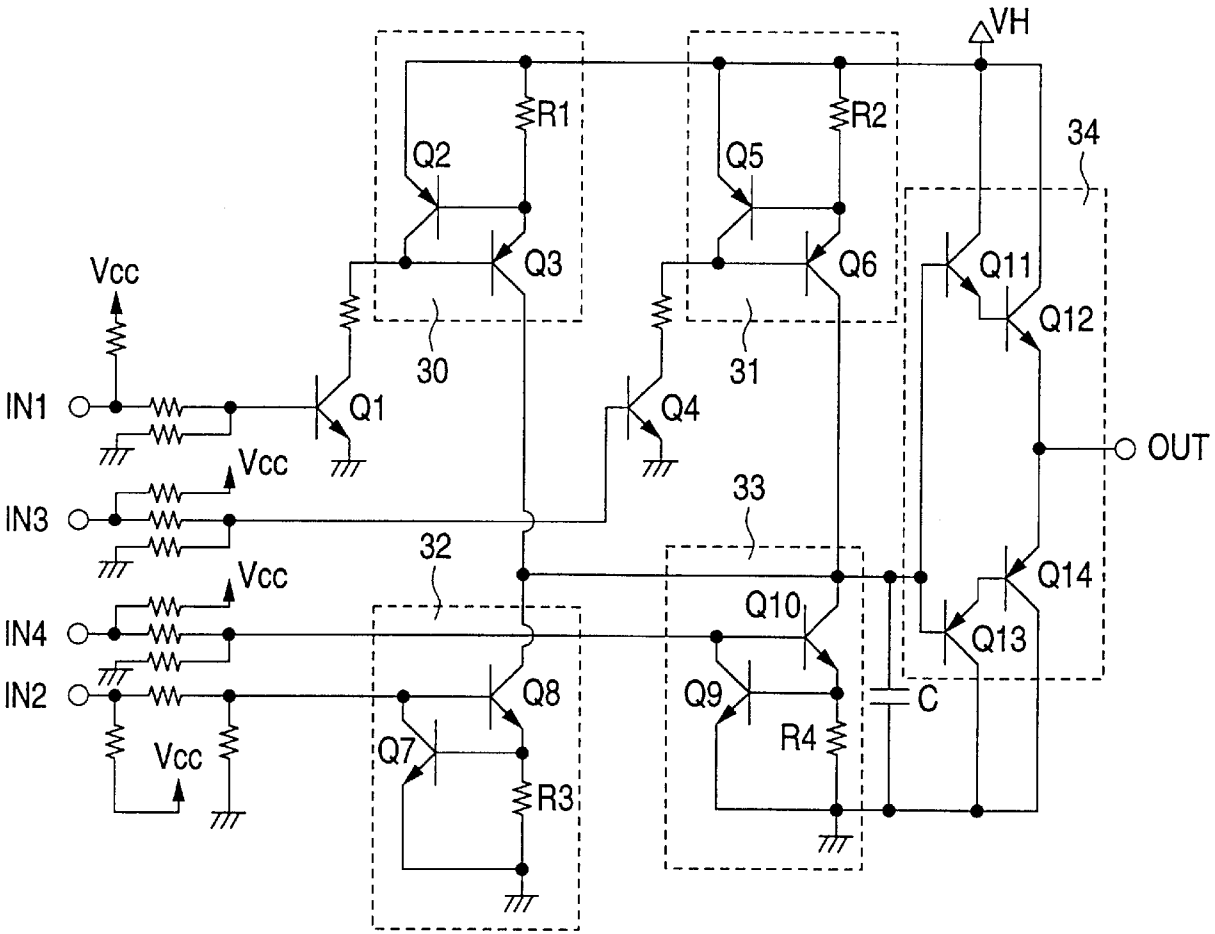
FIG. 3 is a circuit diagram of an example of a drive signal generating circuit in the drive circuit of the invention.

FIG. 3 is a circuit diagram showing an example of the drive signal generating circuit 23.

Figure 4:
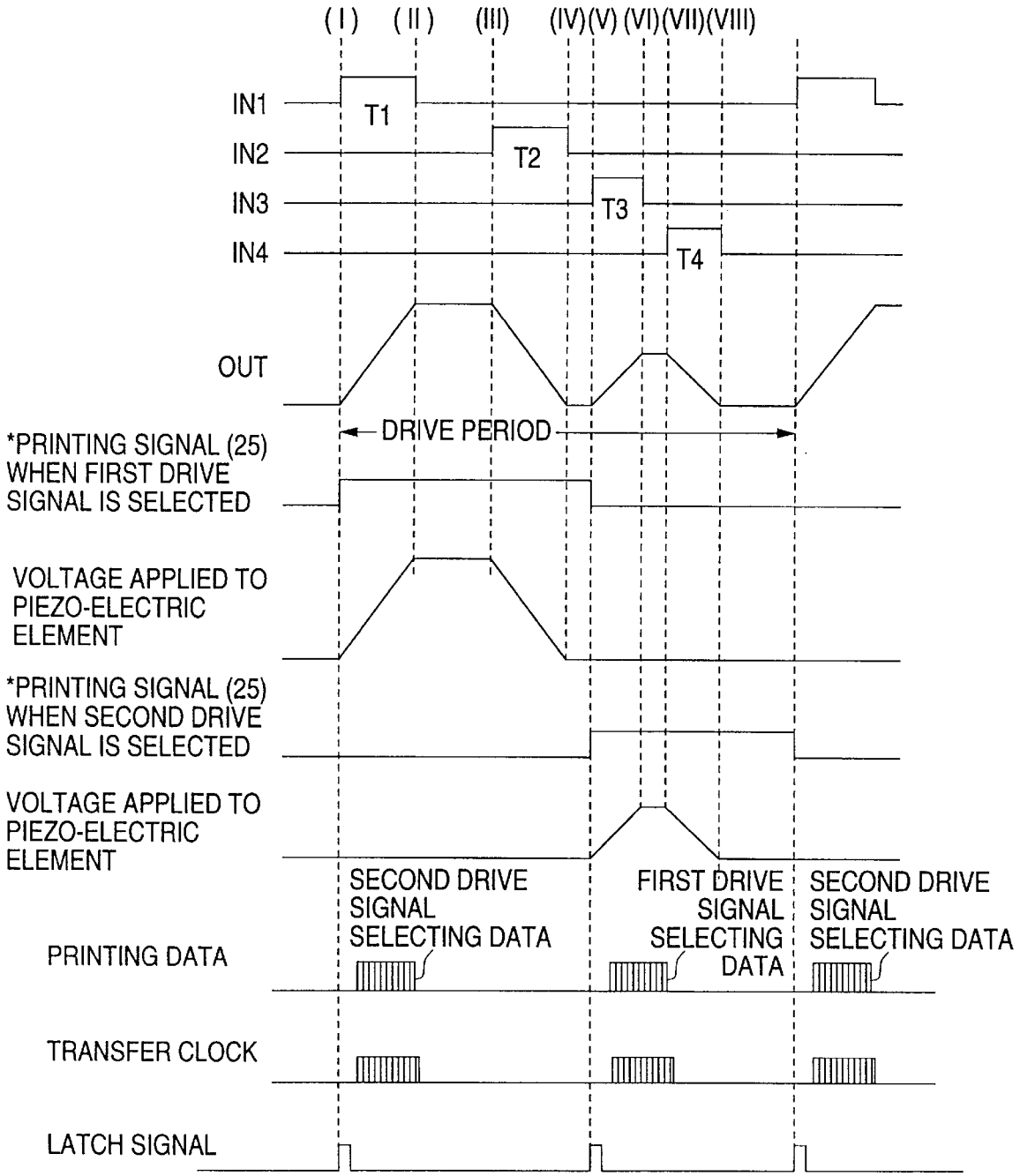
FIG. 4 is a timing chart showing the operation of the drive device according to the invention.

In FIG. 3, reference characters IN1 and IN3 denote input terminals to which a charge signal is applied for contracting the piezo-electric element 6; and IN2 and IN4, input terminals to which a discharge signal is applied for expanding the piezo-electric element 6. The control circuit 21 applies pulse signals (which, as shown in FIG. 4, have pulse widths T1, T2, T3 and T4, respectively,) to the input terminals IN1, IN2, IN3, and IN4, respectively. The terms "charge signal" and "discharge signal" as used herein are intended to mean that they are signals contributing to charge and discharge of the piezo-electric element which is a capacitive load.

The pulse signal (T1) applied to the input terminal IN1 is applied through a level shifting transistor Q1 to a first constant current charge circuit 30, which comprises transistors Q2 and Q3 and a resistor R1, to operate the circuit 30. As a result, a capacitor C is charged with a constant current value. Hence, the terminal voltage of the capacitor C is raised to a predetermined voltage in a period of time $\tau 1$. Hence, a voltage which is substantially equal to the terminal voltage is applied through a current amplifier circuit 34 to an output terminal OUT. Hereinafter, a voltage waveform formed by this pulse signal (T1) will be referred to as "a first voltage waveform".

Similarly, the pulse signal (T3) applied to the input terminal IN3 is applied through a level shifting transistor Q4 to a second constant current charge circuit 31, which comprises transistors Q5 and Q6 and a resistor R2, to operate the circuit 31. As a result, the capacitor C is charged with a constant current value. Hence, the terminal voltage of the capacitor C is raised to a predetermined voltage in a period of time $\tau 4$. Hence, a voltage which is substantially equal to the terminal voltage of the capacitor is applied through the current amplifier circuit 34 to the output terminal OUT. Hereinafter, a voltage waveform formed by this pulse signal (T3) will be referred to as "a fourth voltage waveform".

Similarly, the pulse signal (T2) applied to the input terminal IN2 to operate a first constant current discharge circuit 32, which comprises transistors Q7 and Q8 and a resistor R3, to discharge the capacitor C with a predetermined current. Hence, the terminal voltage of the capacitor C is decreased to a predetermined voltage in a period of time $\tau 3$. Hence, a voltage which is substantially equal to the terminal voltage of the capacitor C is applied through the current amplifier circuit 34 to the output terminal OUT. Hereinafter, a voltage waveform formed by this pulse signal (T2) will be referred to as "a third voltage waveform".

Similarly, the pulse signal (T4) applied to the input terminal IN4 to operate a second constant current discharge circuit 33, which comprises transistors Q9 and Q10 and R4, to discharge the capacitor C with a predetermined current. Hence, the terminal voltage of the capacitor C is decreased to a predetermined voltage in a period of time $\tau 6$. Hence, a voltage which is substantially equal to the terminal voltage of the capacitor C is applied through the current amplifier circuit 34 to the output terminal OUT. Hereinafter, a voltage waveform formed by this pulse signal (T4) will be referred to as "a sixth voltage waveform".

The pulse signals T2 and T4 applied to the input terminals IN2 and IN4 output pulses which are long enough in pulse width to discharge the capacitor C.

A predetermined time interval is provided between the termination of the first voltage waveform and the start of the third voltage waveform, so that a second voltage waveform is produced which maintains the voltage at the same level as the voltage at the end of the first voltage waveform. Similarly, a predetermined time interval is provided between the termination of the fourth voltage waveform and the start of the sixth voltage waveform, so that a fifth voltage waveform is obtained which maintains the voltage at the same level as the voltage at the end of the fourth voltage waveform.

The drive signals applied to the output terminal OUT in the above-described manner are supplied to a plurality of piezo-electric elements 6.

The operation of the drive circuit thus organized will be described with reference to waveforms shown in FIG. 4.

When the pulse signal (T1) shown in FIG. 4 is applied to the terminal IN1 (FIG. 4 (I)), the transistor Q1 is rendered conductive (on), so that the transistor Q3 forming the first constant current charge circuit 30 is rendered conductive (on), and a constant current flows in the capacitor C through the resistor R1. Hence, the terminal voltage of the capacitor C increases at a constant gradient of voltage. Hence, a voltage substantially equal to the terminal voltage of the capacitor C is provided at the output terminal OUT through the current amplifier circuit 34. Owing to the drive voltage, the piezo-electric elements 6, 6, 6, . . . are selectively charged to a predetermined voltage through the transistors S, S, S, . . . which are selectively rendered conductive (on) by printing signals 25, 25, 25, . . . As a result, each selected piezo-electric element S is contracted, so that the pressure generating chamber 9 is expanded and a predetermined quantity of ink is caused to flow from the common ink chamber 11 into the pressure generating chamber 9.

Upon termination of the pulse signal (T1) applied to the terminal IN1 (FIG. 4 (II)), the transistor Q1 is rendered non-conductive (off), so that the charging of the capacitor C is suspended. For the period of time lasting from (II) to (III), the voltage value at the end of charge is maintained, so that the piezo-electric elements 6, 6, . . . are maintained contracted. The period of time from (II) to (III) ends with a pulse signal (T2) being applied to the input terminal IN2 (FIG. 4(III)).

When a pulse signal (T2) shown in FIG. 4 is applied to the terminal IN2 (FIG. 4 (III)–(IV)), the transistor Q8 forming the first constant current discharge circuit 32 is rendered conductive (on), so that the capacitor C is discharged with a predetermined current rate, and accordingly the terminal voltage of the capacitor C is decreased with a predetermined voltage gradient. As a result, only those piezo-electric elements 6 that have been charged to jet ink droplets are discharged with a predetermined voltage gradient through the diodes D, and the piezo-electric elements 6 are expanded according thereto.

As the piezo-electric elements 6 are expanded in this manner, the pressure generating chamber 9 is contracted at a speed corresponding to the speed of expansion of the piezo-electric elements 6, so that a positive pressure is generated in the pressure generating chamber 9, whereby a first ink droplet is jetted from the nozzle opening 2.

In a predetermined period of time, a pulse signal having a pulse width T3 (in FIG. 4) is applied to the terminal IN3 (FIG. 4 (V)). As a result, the transistor Q4 is rendered conductive (on), so that the transistor Q6 forming the second constant current charge circuit 31 is turned on, whereby a predetermined current flows in the capacitor C through the resistor R2. In this connection, the pulse widths T1, T3, and the resistors R1 and R2 are set to meet the following relations:

$$T1/R1>T3/R2, \text{ and } R1<R2$$

As a result, a fourth voltage wave form is produced which has a smaller gradient than the first voltage waveform and whose maximum voltage (at the time instant of FIG. 4 (VI) is less than the maximum voltage (at the time instant of FIG. 4 (II)). With the fourth voltage waveform, only the piezo-electric elements 6 which have been selectively rendered conductive by the printing signals 25 are charged to predetermined voltages. As a result, the piezo-electric elements are contracted, so that the pressure generating chamber 9 is expanded and a predetermined quantity of ink is caused to flow from the common ink chamber 11 into the pressure generating chamber 9.

Upon completion of the application of the pulse signal to the terminal IN3 (FIG. 4 (VI)), the transistor Q4 is rendered non-conductive (off), and therefore the charging of the capacitor C is suspended. For a period of time lasting from (VI) to (VII), a voltage value is maintained which is lower than the voltage value provided at the end of the preceding charging operation (FIG. 4 (II)). The period of time from (VI) to (VII), which ends with a pulse signal (T4) being applied to input terminal IN4 (FIG. 4 (VII), is shorter than the period of time of from (II) to (III).

Upon application of a pulse signal (T4) (shown in FIG. 4) to the terminal IN4, the transistor Q10 forming the second constant current discharge circuit 33 is rendered non-conductive, and the capacitor C is discharged for a period of time $\tau 6$; that is, the terminal voltage of the capacitor C is decreased at a predetermined voltage gradient. Hence, only the piezo-electric elements 6 which have been charged to jet a second ink droplet smaller than the first ink droplet are discharged with a predetermined voltage gradient through the diodes D. Thus, the piezo-electric elements are expanded at the speed corresponding to the discharge.

The pressure generating chamber 9 contracts at a speed corresponding to the speed of expansion of the piezo-electric elements 6, and a positive pressure is generated in the chamber 9, so that the second ink droplet is smaller than the first ink droplet.

FIG. 5 shows how ink droplets are jetted from the nozzle opening. More specifically, parts (a) through (e) of FIG. 5 show the jetting of the first ink droplet, and parts (f) through (j) of FIG. 5 show the jetting of second ink droplet. In addition, part (a) of FIG. 5 corresponds to the time instant (I) in FIG. 4; part (b), to the time instant (II) in FIG. 4; part (c), to the time instant (III) in FIG. 4; part (d) to the time instant (IV) in FIG. 4; part (f), to the time instant (V) in FIG. 4; part (g), to the time instant (VI) in FIG. 4; part (h), to the time instant (VII) in FIG. 4; and part (i), to the time instant (VIII) in FIG. 4.

The first drive signal is high in maximum voltage value, and therefore the pressure generating chamber is expanded to a large volume, whereby the quantity of ink flowing into the pressure generating chamber 9 from the common ink chamber 11 is large (part (b) of FIG. 5). The second voltage waveform forming period is long, so that, after the meniscus 40 is sufficiently restored (part (c) of FIG. 4), the positive pressure is generated. Hence, a large ink droplet can be formed (parts (d) and (e) of FIG. 5).

On the other hand, the second drive signal is small in maximum voltage value, and therefore although the pressure generating chamber is expanded, the quantity of ink flowing into the pressure generating chamber 9 from the common ink chamber is small (part (g) of FIG. 5). In addition, the fifth voltage waveform forming period is short. Hence, with the meniscus 40 retracted (the part (h) of FIG. 5), the pressure generating chamber 9 is contracted, to generate a positive pressure. Thus, a small ink droplet can be formed (the parts (i) and (j) of FIG. 5).

The period of time which elapses from the time instant that the meniscus 40 is retracted until it is restored, depends on an oscillation period corresponding to a Helmholtz frequency of the ink in the chamber. Hence, preferably, the second voltage waveform maintaining time should be longer than the period of time required for the restoration of the meniscus, and should be at least 0.9 times the oscillation period corresponding to the Helmholtz frequency. In addition, the fifth voltage waveform maintaining time should be at most 0.4 times the Helmholtz frequency. In theroy, the fifth voltage waveform maintaining time is perferably zero (0) sec. However, because of transistor switching delay, a zero sec. maintaining time might render the transistors Q12 and Q14 shown in FIG. 3 conductive at the same time, allowing current to penetrate the transistors and damage them. Hence, the fifth voltage waveform maintaining time should be set to a value with which no current penetration occurs with the transistors.

The embodiment has been described so as to meet the following conditions:

(second voltage waveform maintaining time)>(fifth voltage waveform maintaining time), and (second voltage waveform's voltage value)>(fifth voltage waveform's voltage value)

However, it should be noted that to reduce the weight of an ink droplet, it is also possible to employ each of the above conditions separately. That is, if at least one of the conditions is satisfied, the same effect can be obtained. In addition, by slowly retracting the meniscus, the weight of the ink droplet can be decreased. In other words, after the meniscus has been retracted, the inertial force of the ink towards the nozzle opening 2 from the ink supply holes 10 is decreased–the lower the inertial force of the ink, the less the weight of an ink droplet jetted from the nozzle. Hence, by satisfying the condition ($\tau 1<\tau 4$), the same effect can be obtained. In addition, by combining this condition with the above-described two conditions, the resultant drive device is markedly improved in operating effect or merit.

In the above-described embodiment, the weight of the first ink droplet is set to the value with which the recording sheet can be printed, in its entirety, with the ink droplets with no spaces left therebetween. For instance, in the case of a print resolving power of 720 dpi, the recording dot diameter of the first ink droplet is set to about 70 $\mu$m with the droplet landing accuracy taken into account.

Next, a method of selecting the first drive signal or the second drive signal will be described.

Printing data is transferred, in a serial mode, from the memory 22 to the shift register 27. In this operation, being divided into a first data train for selecting the first drive signal, and into a second data train for selecting the second drive signal, the printing data is transferred in synchronization with a transfer clock signal with the timing shown in FIG. 4. That is, the printing data for selecting the first drive signal is transferred to the shift register 27 during the period in which the preceding second drive signal is generated, and the printing data for selecting the second drive signal is transferred to the shift register during the period in which the preceding first drive signal is generated. And in synchronization with the first or second drive signal, the data stored in the shift register 27 is stored in the latch circuit 26 with the aid of a latch signal, and printing signals 25 are applied to the control terminals of the transistors S.

The printing data is transferred in such a manner that the first and second drive signals are not selected simultaneously within one drive period. Hence, with respect to the drive signals applied to the piezo-electric element 6, there are three cases: in the first case, the first drive signal is applied to the piezo-electric element 6; in the second case, the second drive signal is applied thereto; and in the third case, none of the first and second drive signals is applied thereto.

It is assumed that one period from the generation of a first drive signal to the generation of the next first drive signal is represented by Df0. In the embodiment, the period Df0 is set to a value with which the first ink droplet which is large in weight can be driven continuously and most quickly; that is, it is set to the maximum drive period of the printing head.

On the other hand, in the invention, in one drive period, the timing is such that two different size ink droplets are jetted. Hence, as is apparent from the parts (a) and (b) of FIG. 6, sometimes the drive period is not Df0. In the case of the part (a) of FIG. 6, after the second drive signal is applied, the first drive signal is applied, and therefore the drive period Df12 is shorter than Df0. On the other hand, in the case of the part (b) of FIG. 6, after the first drive signal has been applied, the second drive signal is applied, and therefore the drive period Df21 is longer than Df0.

In the case of the jet timing shown in the part (a) of FIG. 6, the maximum drive period Df0 is exceeded. However, in the embodiment, the ink jetting characteristic is not affected thereby because of the following reason:

FIG. 7(*a*) is a graphical representation indicating first ink drop speeds and weights with drive time intervals which elapse from the application of the second drive signals until the first drive signals are applied, respectively. FIG. 7(*b*) is a graphical representation indicating second ink drop speeds and weights with drive time intervals which elapse from the application of the first drive signals until the second drive signals are applied, respectively. As is seen from parts (a) and (b) of FIG. 7, even if, in the case where the first drive signal is applied after the second drive signal, the drive period is shorter than Df0, the characteristic is maintained unchanged. This is due to the fact that the time required for eliminating the residual oscillation of the meniscus after the ink has been jetted is variable.

FIG. 8 is a graphical representation indicating the residual oscillation of the meniscus. More specifically, FIG. 8 shows that, after the application of the first drive signal, the residual oscillation lasts for a relatively long period of time because the ink droplet jetted is relatively heavy; and that, after the application of the second drive signal, the residual oscillation is eliminated quickly because the ink droplet jetted is relatively light. In other words, in the case where the first drive signals are continuously applied to the piezo-electric element 6, it is impossible to make the drive period shorter than Df0; however, if the weight of the ink droplet jetted immediately before is smaller than that of the first ink droplet, then the residual oscillation is quickly eliminated, and therefore it is possible to temporarily make the drive period shorter than Df0.

Hence, as shown in part (a) of FIG. 6, it is possible to shorten the period of time which elapses from the application of the second drive signal to the piezo-electric element 6 until the first drive signal is applied to the piezo electric element 6. Thus, with the drive device of the invention, the printing speed is higher than that with the conventional one. Furthermore, as shown in the part (b) of FIG. 6, the period of time which elapses from the time instant that the first drive signal is applied to the piezo-electric element 6 until the second drive signal is applied thereto is sufficiently long, which makes it possible to stably jet a small ink droplet.

In the above-described embodiment, two kinds of ink droplets having different sizes are jetted; however, the invention is not limited thereto or thereby. That is, the technical concept of the invention is applicable to the case where more than two sizes of ink droplets are jetted. In this case, a plurality of drive signals are successively generated to jet ink droplets beginning with the largest one in a printing cycle, and one of the drive signals thus generated is applied to the piezo-electric element 6.

Concrete values of the various elements in the above-described embodiments were as follows:

Ink inherent. 8 $\mu$s

First voltage waveform rise time $\tau 1$: 14 $\mu$s

Second voltage waveform: 8 $\mu$s

Third voltage waveform fall time $\tau 3$: 7 $\mu$s

First drive signal maximum voltage value: 40 V

Fourth voltage waveform rise time $\tau 4$: 10 $\mu$s

Fifth voltage waveform: 2 $\mu$s

Sixth voltage waveform fall time $\tau 6$: 7 $\mu$s

Second drive signal maximum voltage value: 22 V

Under the above-described conditions, the first ink droplet was 0.027 $\mu$g in size, the second ink droplet was 0.009 $\mu$g in size, the dot recorded with the first ink droplet was 70 $\mu$m, and the dot recorded with the second ink droplet was 40 $\mu$m.

As was described above, with the drive device of the invention, after the first drive signal is applied to jet a relatively large size ink droplet, the second drive signal is applied to jet a relatively small size ink droplet, and one of the first and second drive signals is selected according to a given density signal. Hence, ink droplets having different sizes can be jetted from the same nozzle without changing the drive frequency. Thus, with a printing head having the drive device of the invention, an image having high picture quality and gradation can be printed at high speed.

What is claimed is:

1. An ink jet printing head drive device comprising:

a piezo-electric element confronting a pressure generating chamber, wherein the chamber is expanded and contracted by said piezo-electric element to jet ink droplets from a nozzle opening in the pressure generating chamber;

a drive signal generating circuit which outputs within one printing period a first drive signal associated with said piezo-electric element jetting a relatively large ink droplet from the nozzle opening, and a second drive signal in succession to said first drive signal associated with said piezo-electric element jetting a relatively small ink droplet from the nozzle opening; and a selecting circuit which selects, in the printing period, only one of said first drive signal and said second drive signal, and applies said drive signal thus selected to said piezo-electric element.

2. An ink jet printing head drive device comprising:

a piezo-electric element confronting a pressure generating chamber, wherein the chamber is expanded and contracted by said piezo-electric element to jet ink droplets from a nozzle opening in the pressure generating chamber;

a drive signal generating circuit which outputs within one printing period a first drive signal associated with said piezo-electric element jetting a relatively large ink droplet from the nozzle opening, and a second drive signal in succession to said first drive signal associated with said piezo-electric element jetting a relatively small ink droplet from the nozzle opening; and a selecting circuit which selects, during the printing period, only one of said first drive signal and said second drive signal, and applies said drive signal thus selected to said piezo-electric element;

wherein said first drive signal comprises:

a first voltage waveform associated with said piezo-electric element expanding the pressure generating chamber, a second voltage waveform associated with said piezo-electric element maintaining the pressure generating chamber in an expanded state, and a third voltage waveform associated with said piezo-electric element contracting the pressure generating chamber; and wherein said second drive signal comprises:

a fourth voltage waveform associated with said piezo-electric element expanding the pressure generating chamber;

a fifth voltage waveform associated with said piezo-electric element maintaining the pressure generating chamber in an expanded state; and a sixth voltage waveform associated with said piezo-electric element contracting the pressure generating chamber.

3. A drive device as claimed in claim 2, wherein a time of application of said first voltage waveform is shorter than a time of application of said fourth voltage waveform.

4. A drive device as claimed in claim 2, wherein a time of application of said second voltage waveform is longer than a time of application of said fifth voltage waveform.

5. A drive device as claimed in claim 2, wherein said second voltage waveform is higher in voltage than said fifth voltage waveform.

6. A drive device as claimed in claim 2, wherein a period for which said second voltage waveform is maintained is at least about 0.9 times an oscillation period corresponding to a Helmholtz frequency of ink jetted by the printing head.

7. a drive device as claimed in claim 2, wherein a period for which said fifth voltage waveform is maintained is no more than about 0.4 times an oscillation period corresponding to a Helmholtz frequency of ink jetted by the printing head.

* * * * *